US008961199B2

(12) United States Patent
Tai et al.

(10) Patent No.: US 8,961,199 B2
(45) Date of Patent: Feb. 24, 2015

(54) ELECTRICAL CONNECTOR WITH IMPROVED CONTACT STRUCTURES

(71) Applicant: Alltop Electronics (Suzhou) Ltd., Taicang, JiangSu Province (CN)

(72) Inventors: Hung-Chi Tai, Jhonghe (TW); Yung-Chih Hung, Jhonghe (TW)

(73) Assignee: Alltop Electronics (Suzhou) Ltd., Taicang, Jiangsu Province (CN)

( * ) Notice: Subject to any disclaimer, the term of this patent is extended or adjusted under 35 U.S.C. 154(b) by 0 days.

(21) Appl. No.: 14/021,562

(22) Filed: Sep. 9, 2013

(65) Prior Publication Data

US 2014/0370759 A1 Dec. 18, 2014

(30) Foreign Application Priority Data

Jun. 17, 2013 (CN) ..... 2013 1 0238767

(51) Int. Cl.
*H01R 12/00* (2006.01)
*H01R 12/70* (2011.01)

(52) U.S. Cl.
CPC ..... *H01R 12/7076* (2013.01)
USPC ..... 439/79

(58) Field of Classification Search
USPC ..... 439/79, 80, 947
See application file for complete search history.

(56) References Cited

U.S. PATENT DOCUMENTS 6,926,542 B2 * 8/2005 Li ..... 439/79
7,744,380 B2 * 6/2010 Shuey et al. ..... 439/79
7,794,259 B2 * 9/2010 Zhu et al. ..... 439/327

* cited by examiner

*Primary Examiner* — Phuong Dinh
(74) *Attorney, Agent, or Firm* — Sughrue Mion, PLLC

(57) ABSTRACT

An electrical connector includes an insulative housing and at least one first contact received in the insulative housing. The insulative housing includes a main body and a first mating port extending from the main body. The at least one first contact includes a first mating portion partially exposed into the first mating port, a first intermediate portion extending rearward from the first mating portion and received in the main body, and a first termination portion bending downward from the first intermediate portion and exposed beyond the insulative housing. The first intermediate portion includes a first lower horizontal section, a first upper horizontal section parallel to the first lower horizontal section, and a first connecting portion connecting the first lower horizontal section and the first upper horizontal section. The first lower horizontal section is formed with a first lower widened section, and the first upper horizontal section is formed with a first upper widened section.

12 Claims, 12 Drawing Sheets

ELECTRICAL CONNECTOR WITH IMPROVED CONTACT STRUCTURES

BACKGROUND OF THE INVENTION

1. Field of the Invention

The present invention relates to an electrical connector, more particularly to an electrical connector mounted on a Printed Circuit Board (PCB).

2. Description of Related Art

With the miniaturization of electric products, electrical connectors with low-profile, high-current are adopted by customers gradually. The structures of conventional electrical connectors cannot fulfill the requirements of low-profile, and high-current. The height of the electrical connector is higher, the total height of an electronic product in which the electrical connector is assembled is higher. Hence, the inner space of the electronic product is limited by the height of the electrical connector, and cannot be designed and utilized flexibly. In addition, with the light and thin trend for electric products, how to utilize the limited space inside of the electrical product to position contacts of the electrical connector is a technical difficulty to be solved.

Hence, it is necessary to improve the conventional electrical connector to address problems mentioned above.

BRIEF SUMMARY OF THE INVENTION

Accordingly, an object of the present invention is to provide an electrical connector having contacts which are capable of being retained to an insulative housing thereof reliably and stably.

In order to achieve the above-mentioned object, an electrical connector in accordance with the present invention comprises an insulative housing and at least one first contact received in the insulative housing. The insulative housing comprises a main body and a first mating port extending from the main body. the first mating port defines a first receiving space therein, and the main body defines at least one front first receiving passage communicating with the first receiving space and at least one rear first receiving channel spaced from the front first receiving passage along a front-to-back direction and an up-to-down direction. The at least one first contact comprises a first mating portion partially exposed into the first receiving space of the first mating port, a first intermediate portion extending rearward from the first mating portion and received in the first receiving passage and the first receiving channel, and a first termination portion bending downward from the first intermediate portion and exposed beyond the insulative housing. The first intermediate portion comprises a first lower horizontal section received in the first receiving passage, a first upper horizontal section parallel to the first lower horizontal section and received in the first receiving channel, and a first connecting portion connecting the first lower horizontal section and the first upper horizontal section and extending between the first receiving passage and the first receiving channel. The first lower horizontal section is formed with a first lower widened section to interferentially engage with the first receiving passage, and the first upper horizontal section is formed with a first upper widened section to interferentially engage with the first receiving channel.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
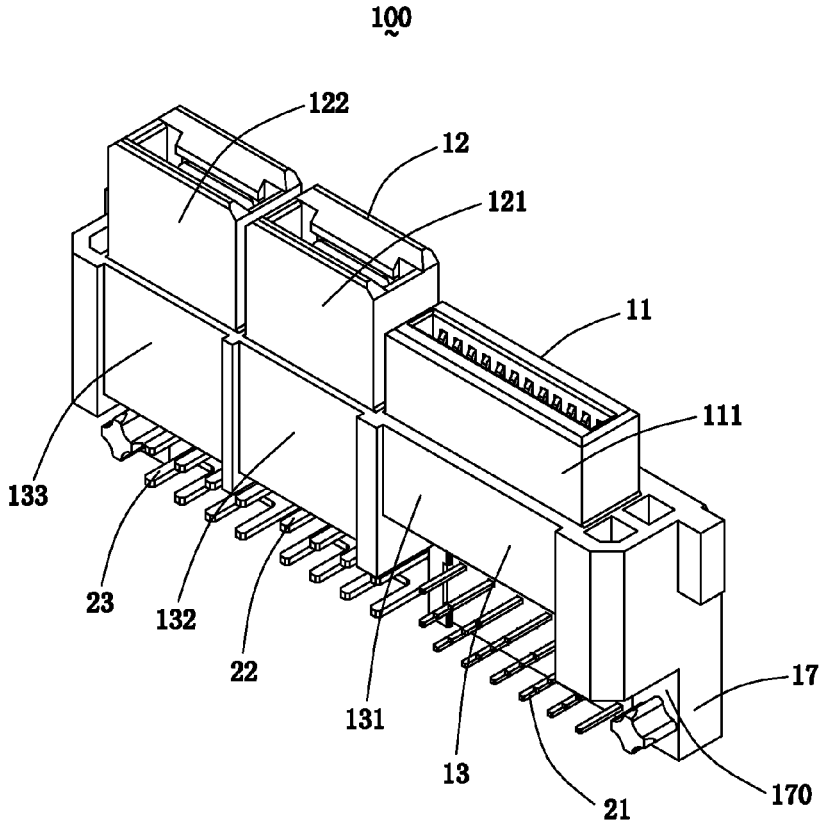
FIG. 1 is an assembled, perspective view of an electrical connector in accordance with the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
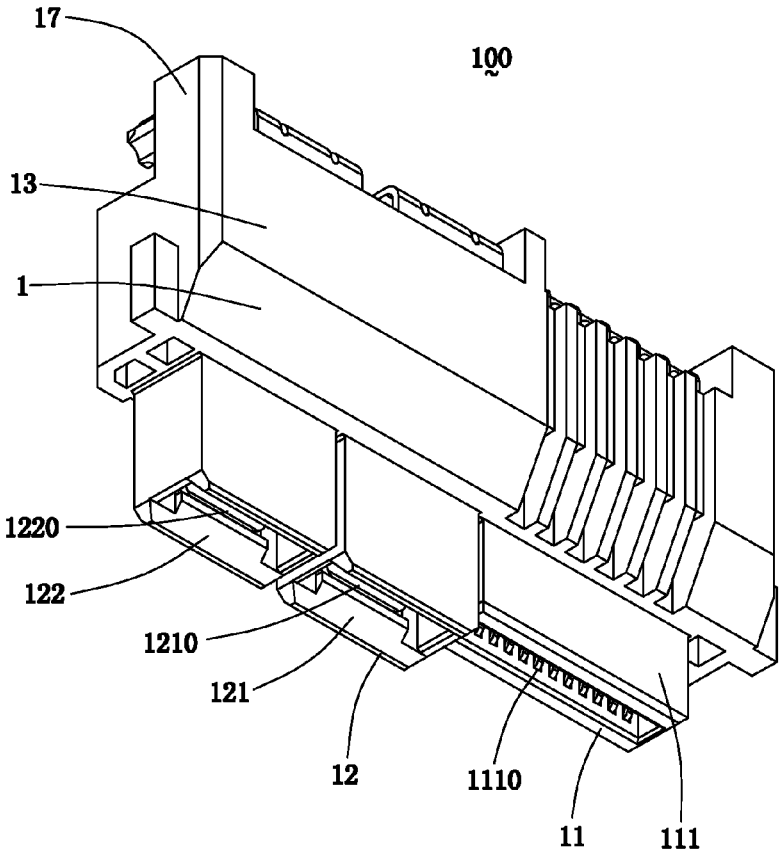
FIG. 2 is a view similar to FIG. 1, but from a different aspect.
Figure 3:
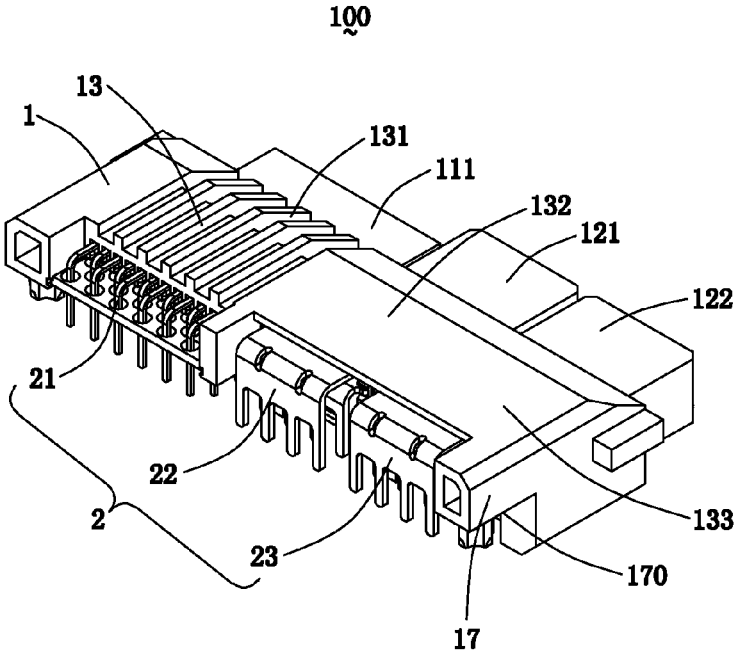
FIG. 3 is a view similar to FIG. 1, but from another different aspect.
Figure 4:
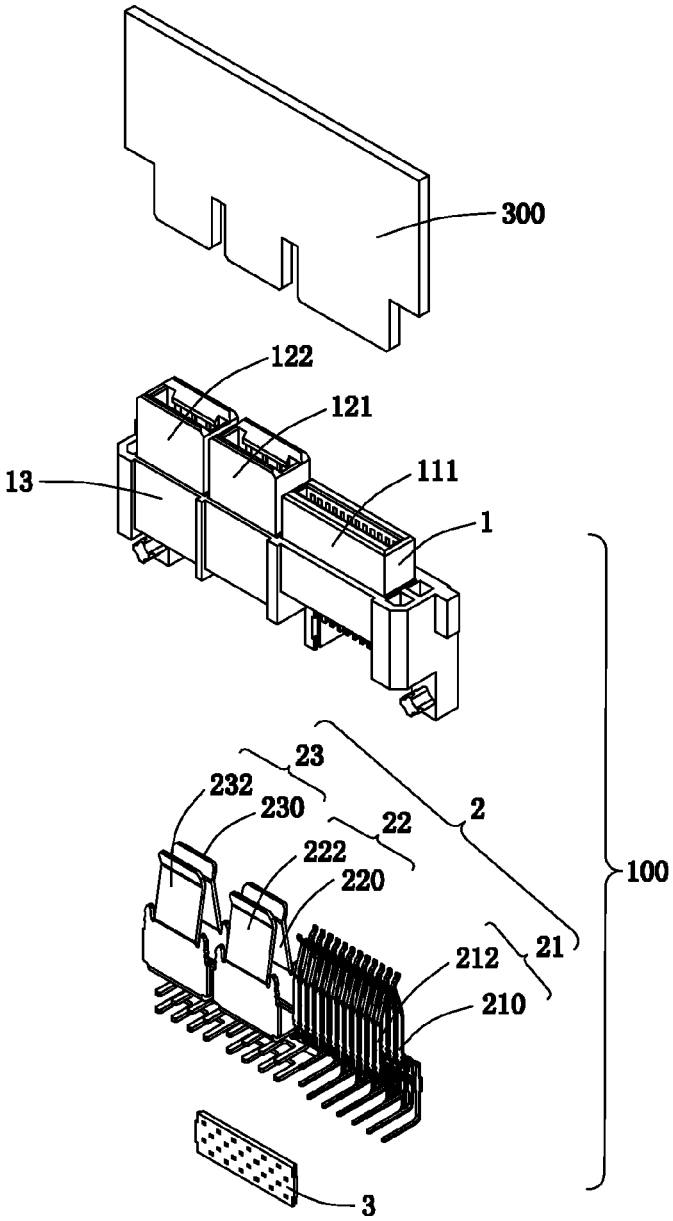
FIG. 4 is an exploded, perspective view of the electrical connector in accordance with the present invention, with a Printed Circuit Board (PCB) shown together.
Figure 5:
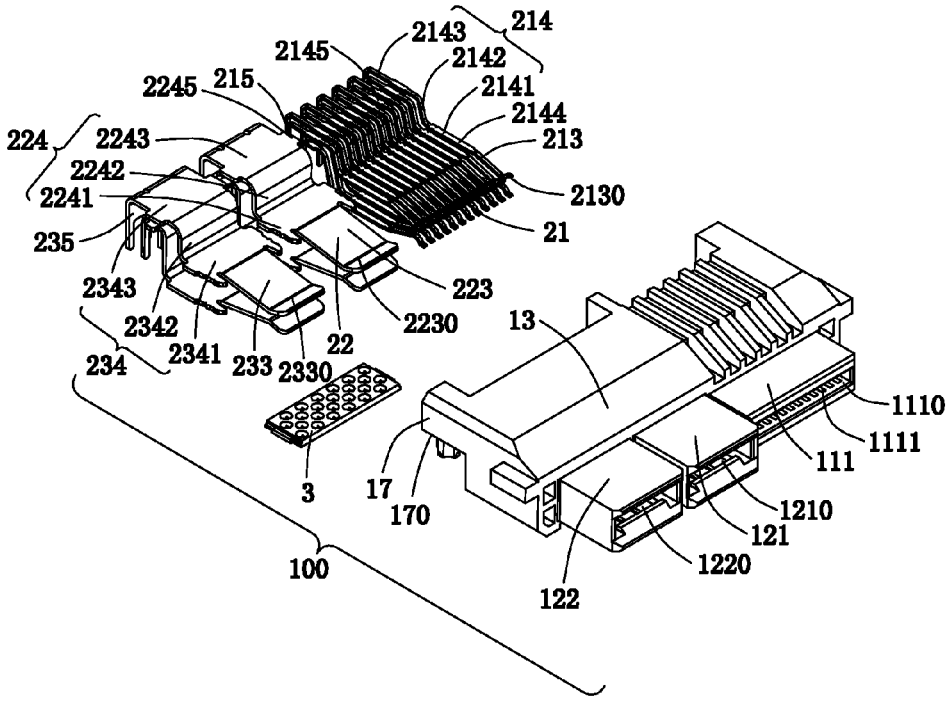
FIG. 5 is an exploded, perspective view of the electrical connector in accordance with the present invention.
Figure 6:
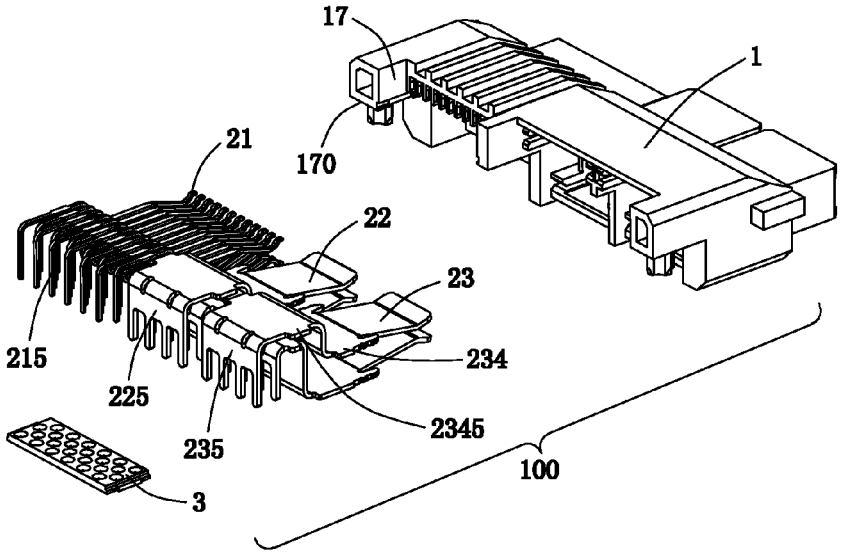
FIG. 6 is a view similar to FIG. 5, but from a different aspect.
Figure 7:
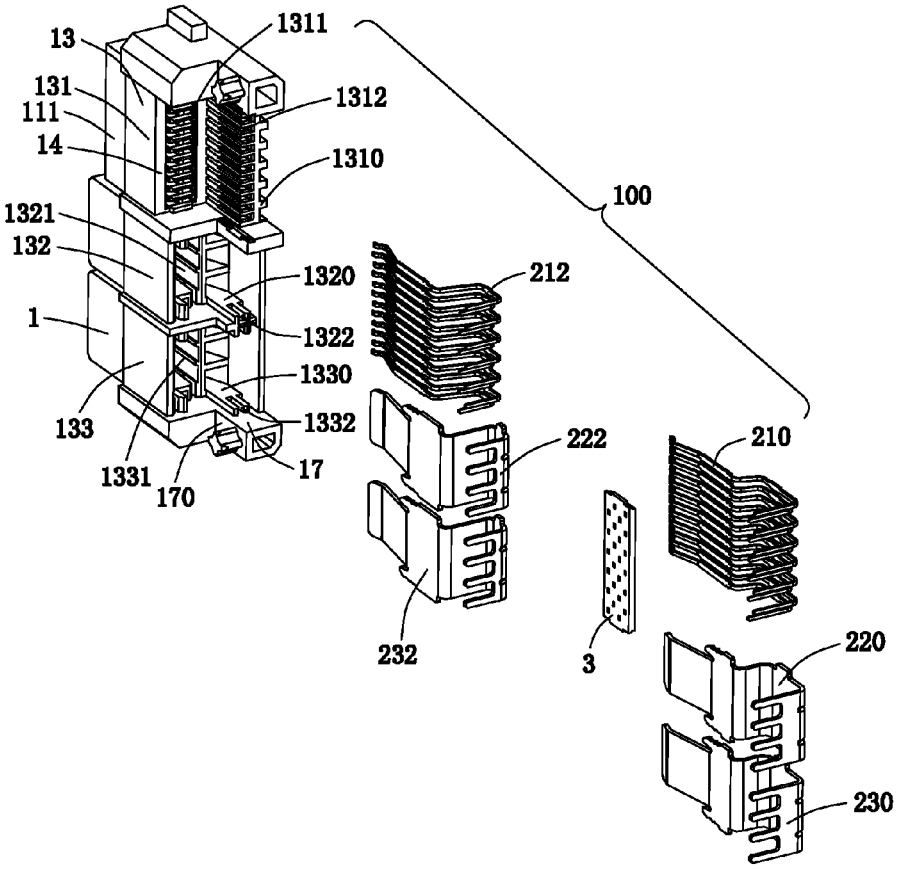
FIG. 7 is a further exploded, perspective view of the electrical connector in accordance with the present invention.
Figure 8:
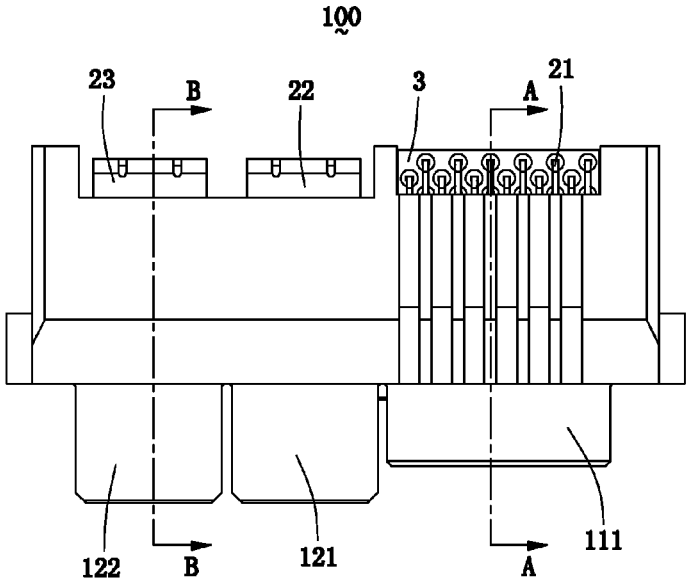
FIG. 8 is a top view of FIG. 2.
Figure 9:
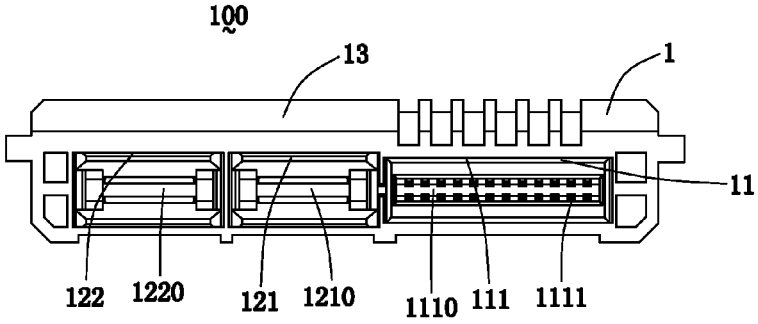
FIG. 9 is a front view of FIG. 2.

Please refer to FIGS. 1-9, an electrical connector 100 in accordance with the present invention is used to be assembled to a Printed Circuit Board (PCB) and form an electrical connection with a complementary device 300. The electrical connector 100 comprises an insulative housing 1 and a plurality of contacts 2 assembled in the insulative housing 1. The electrical connector 100 in accordance with the present invention is an electrical connector of low-profile and high-current.

The contacts 2 are grouped into a group of first contacts 21, a group of second contacts 22 and a group of third contacts 23. The group of first contacts 21 is divided and arranged into two rows of signal contacts, a row of upper first contacts 210 and a row of lower first contacts 212. The group of second contacts 22 comprises a pair of power contacts which comprise an upper second contact 220 and a lower second contact 222. The group of third contacts 23 is identical as the group of second contacts 22 and also comprises an upper third contact 230 and a lower third contact 232.

Figure 10:
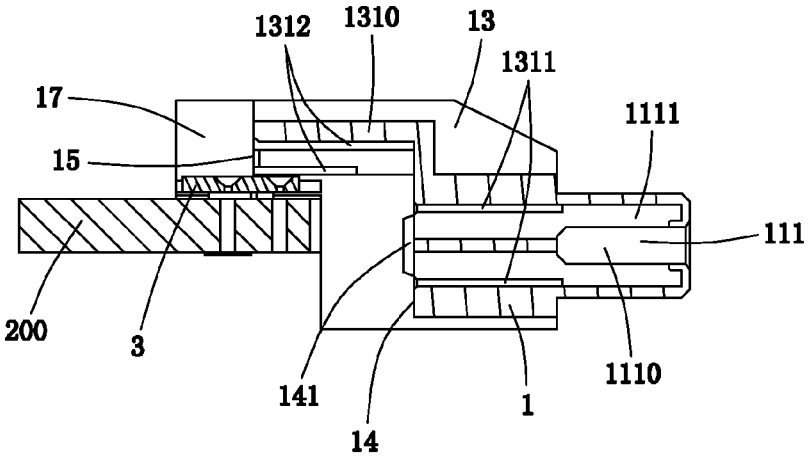
FIG. 10 is a cross-sectional view of an insulative housing of the electrical connector in accordance of the present invention, with the PCB in a first position relative to the electrical connector.
Figure 11:
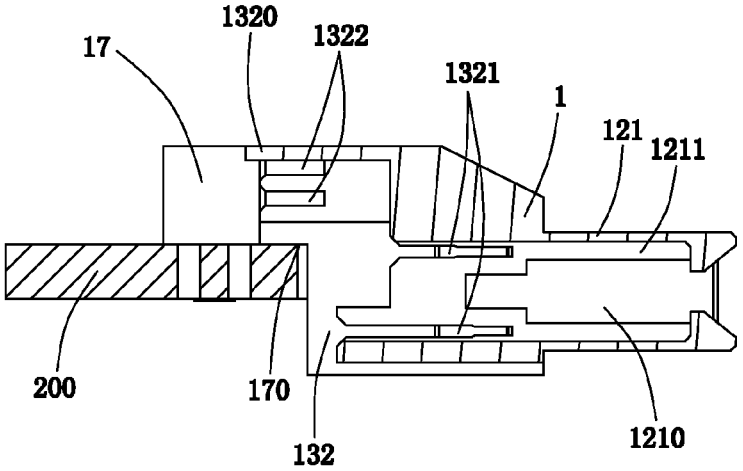
FIG. 11 is a cross-sectional view of the insulative housing of the electrical connector in accordance of the present invention, with the PCB in a second position relative to the electrical connector.
Figure 12:
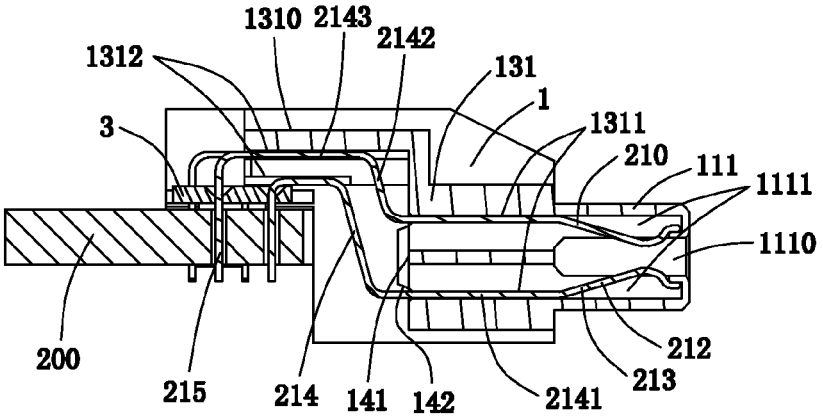
FIG. 12 is a cross-sectional view of the electrical connector taken along line A-A in FIG. 8.
Figure 13:
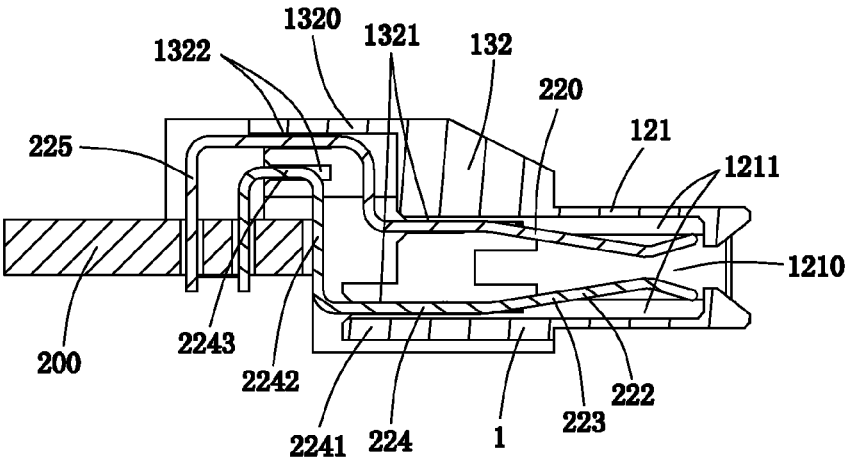
FIG. 13 is a cross-sectional view of the electrical connector taken along line B-B in FIG. 8.
Figure 14:
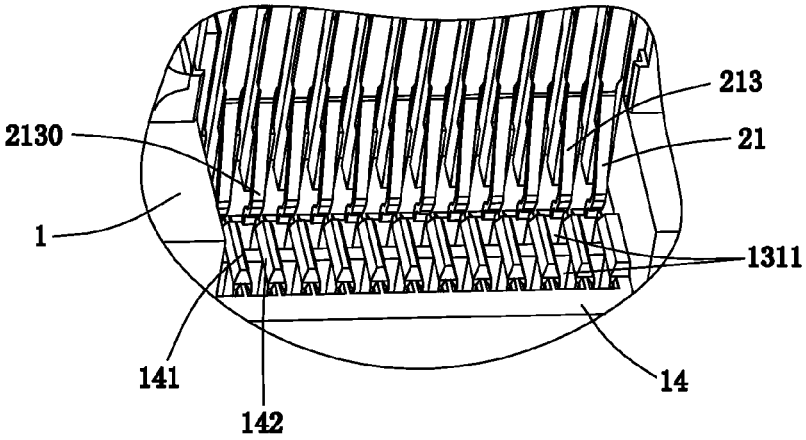
FIG. 14 is a partially enlarged view of the insulative housing without first contacts assembled therein.
Figure 15:
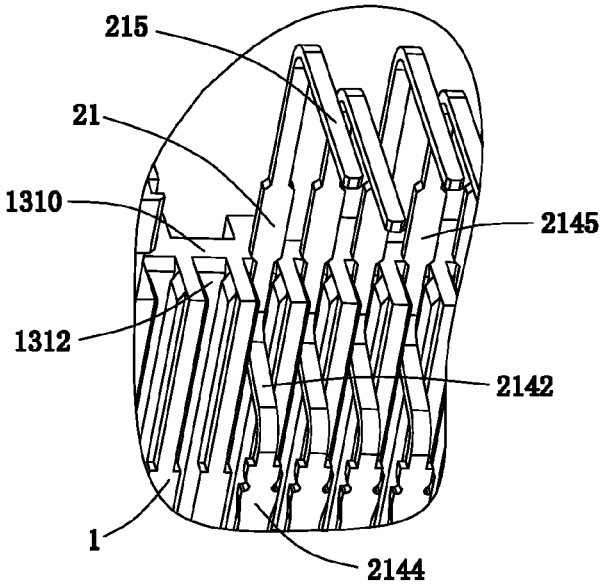
FIG. 15 is a partially enlarged view of the insulative housing with the first contacts partially assembled therein.
Figure 16:
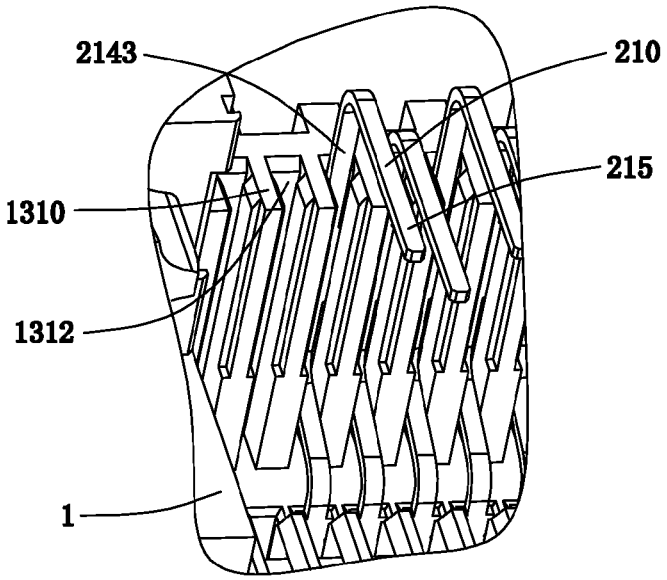
FIG. 16 is a partially enlarged view of the insulative housing with the first contacts fully assembled therein.
Figure 17:
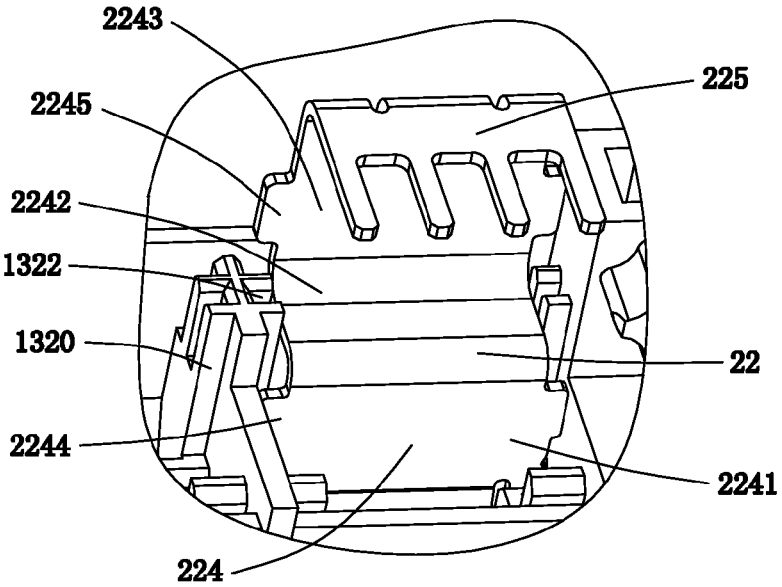
FIG. 17 is a partially enlarged view of the insulative housing before second contacts assembled therein.

Please refer to FIGS. 10-17, the insulative housing 1 comprises a common main body 13, a first mating port 111, a second mating port 121, and a third mating port 122 extending forwardly from a center section of the common main body 13. The first mating port 111, the second mating port 121 and the third mating port 122 are arranged side by side, and the second mating port 121 and the third mating port 122 are identical. For describing the present invention more clearly, the common main body 13 is also divided as a first main section 131 corresponding to the first mating port 111, a second main section 132 corresponding to the second mating port 121, and a third main section 133 corresponding to the third mating port 122. The first mating port 111 has a front first mating surface 11, the second and third mating ports 121, 122 has a second mating surface 12 which is located before the first mating surface 11 along a mating direction of the electrical connector 100 with the complementary device 300.

The first main section 131 is of L-shape with a first stretch section 1310 extending rearward from an upper section thereof to make the first main section 131 L-shape. Thus, the first main section 131 has a first rear surface 14 and a second rear surface 15 on the first stretch section 1310 with the first rear surface 14 closer to the first mating surface 11 than the second rear surface 15. The first mating port 111 defines a first receiving space 1110 and two rows of first receiving slots 1111 in opposite upper and lower walls thereof and both facing to the first receiving space 1110. The first main section 131 defines two rows of first receiving passages 1311 arranged along a height direction of the first main section 131 and respectively aligning with the two rows of first receiving slots 1111, and two rows of first receiving channels 1312 in the first stretch section 1310 arranged along a height direction of the first stretch section 1310.

The second main section 132 is of L-shape with a second stretch section 1320 extending rearward from an upper section thereof to make the second main section 132 L-shape. The second mating port 121 defines a second receiving space 1210 and two rows of second receiving slots 1211 in opposite upper and lower walls thereof and both facing to the second receiving space 1210. The second main section 132 defines two rows of second receiving passages 1321 arranged along a height direction of the second main section 132 and respectively aligning with the two rows of second receiving slots 1211, and two rows of second receiving channels 1322 in the second stretch section 1320 arranged along a height direction of the second stretch section 1320.

The third main section 133 and the third mating port 122 have the identical structures as that of the second main section 132 and the second mating port 121. The third main section 133 is of L-shape with a third stretch section 1330 extending rearward from an upper section thereof to make the third main section 133 L-shape. The third mating port 122 defines a third receiving space 1220 and two rows of second receiving slots 1221 in opposite upper and lower walls thereof and both facing to the third receiving space 1220. The third main section 133 defines two rows of third receiving passages 1331 arranged along a height direction of the third main section 133 and respectively aligning with the two rows of third receiving slots 1221, and two rows of third receiving channels 1332 in the third stretch section 1330 arranged along a height direction of the third stretch section 1330.

In the preferred embodiment of the present invention, the electrical connector 100 is a sink-type electrical connector for achieving low-profile. A pair of mounting sections 17 is formed at opposite lateral ends of the insulative housing 1 and respectively near to the first stretch section 1310 and the third stretch section 1330 for interferentially engaging with the PCB 200. A bottom surface 170 of the mounting sections 17 is served as a mounting surface which is higher than a bottom surface of the first mating port 111.

Each upper first contact 210 comprises a first mating portion 213 with a curved first contacting end 2130 bending toward the first receiving space 1110 for electrically connecting with the complementary device 300, a Z-shape first intermediate portion 214 extending rearward from the first mating portion 213, and a first termination portion 215 bending downward from a free end of the first intermediate portion 214 for electrically connecting with the PCB 200. The first intermediate portion 214 comprises a first lower horizontal section 2141 connecting with the first mating portion 213, a first upper horizontal section 2143 higher than and parallel to the first lower horizontal section 2141 and connecting with the first termination portion 215, and an inclined first connecting section 2142 connecting with the first lower horizontal section 2141 and the first upper horizontal section 2143. The first mating port 111 is located between the first upper horizontal section 2143 and the first lower horizontal section 2141 in the height direction.

The first lower horizontal section 2141 is widened on both opposite lateral sides to form a flat first lower widened section 2144 for interferentially engaging with the first receiving passage 1311 defined in the first main section 131. The first upper horizontal section 2143 is partially widened on both lateral sides to form a flat first upper widened section 2145 for interferentially engaging with the first receiving channel 1312 in the first stretch section 1310. Such a Z-shape intermediate portion 214 could satisfy mounting requirements of a low-profile electrical connector. In addition, since the first contact 21 is relatively long, the first lower widened section 2144 and the first upper widened section 2145 could provide more support to the first contact 21 via the engagement with the first receiving passage 1311 and the first receiving channel 1312. In an alternative embodiment, the widened sections 2144, 2145 also could be barbs. The first rear surface 14 forms a plurality of guiding ribs 141 with inclined guiding surfaces 142 between two adjacent first receiving passages 1311 for guiding the insertion of the upper and lower first contacts 210, 212 from a back-to-front direction.

Each lower first contacts 212 has the substantially the same structure as that of the upper first contacts 210, except the curved directions of the first contacting ends 2130 are opposite to each other, and both toward the first receiving space 1110, and the lengths of the first connecting section 2142 and the first lower horizontal section 2141 of the lower first contact 212 is longer than that of the first connecting section 2142 and the first lower horizontal section 2141 of the upper first contact 210, while the length of the first upper horizontal section 2143 of the lower first contact 212 is shorter than that of the first upper horizontal section 2143 of the upper first contact 210. Thus, the shorter first termination portion 215 of the lower first contact 212 is located in front of the longer first termination portion 215 of the upper first contact 210. In summary, the pair of the first mating portions 213 are arranged symmetrically and received in the pair of first receiving slots 1111 of the first mating port 111, while the other structure of the upper and lower first contacts 210, 212 are parallel to one another, with the lower first contact 212 beneath the upper first contact 210. The first termination portions 215 of the upper and lower first contacts 210, 212 are arranged into four rows and pass through a plurality of holes defined in a spacer 3 for being connected to the PCB 200.

Each second contact 22 is much wider than the first contact 21 for satisfying high-current transmission requirements. Each upper second contacts 220 comprises a second mating portion 223 with a curved second contacting end 2230 bending toward the second receiving space 1210 for electrically connecting with the complementary device 300, a Z-shape second intermediate portion 224 extending rearward from the second mating portion 223, and a second termination portion 225 bending downward from a free end of the second intermediate portion 224 for electrically connecting with the PCB 200. The second intermediate portion 224 comprises a second lower horizontal section 2241 connecting with the second mating portion 223, a second upper horizontal section 2243 higher than and parallel to the second lower horizontal section 2241 and connecting with the second termination portion 225, and an inclined second connecting section 2242 connecting with the second lower horizontal section 2241 and the second upper horizontal section 2243. The second termination portion 225 is bifurcated to form four legs for being soldered with the PCB 200.

The second lower horizontal section 2241 is partially widened on both opposite lateral sides to form a flat second lower widened section 2244 for interferentially engaging with the second receiving passage 1321 defined in the second main section 132. The second upper horizontal section 2243 is partially widened on both lateral sides to form a flat second upper widened section 2245 for interferentially engaging with the second receiving channel 1322 in the second stretch section 1320. In the preferred embodiment of the present invention, the two opposite sides of the second lower widened section 2244 are formed with a plurality of barbs for retaining the second contact 22 in the insulative housing 1 more stably. The two opposite sides of the second upper widened section 2245 are flat for being assembled conveniently.

Each lower second contacts 222 has the substantially the same structure as that of the upper second contacts 220, except the curved directions of the second contacting ends 2230 are opposite to each other, and both toward the second receiving space 1210, and the lengths of the second connecting section 2242 and the second lower horizontal section 2241 of the lower second contact 222 is longer than that of the second connecting section 2242 and the second lower horizontal section 2241 of the upper second contact 220, while the length of the second upper horizontal section 2243 of the lower second contact 222 is shorter than that of the second upper horizontal section 2243 of the upper second contact 220. Thus, the shorter second termination portion 225 of the lower second contact 222 is located in front of the longer second termination portion 225 of the upper second contact 220. In summary, the pair of second mating portions 223 are arranged symmetrically and received in the pair of second receiving slots 1211 of the second mating port 121, while the other structure of the upper and lower second contacts 220, 222 are parallel to one another, with the lower second contact 222 beneath the upper second contact 220.

The group of third contacts 23 have the identical structures and arrangements as those of the group of second contacts 22. Each third contact 23 is much wider than the first contact 21 for satisfying high-current transmission requirements. Each upper third contacts 230 comprises a third mating portion 233 with a curved third contacting end 2330 bending toward the third receiving space 1220 for electrically connecting with the complementary device 300, a Z-shape third intermediate portion 234 extending rearward from the third mating portion 233, and a third termination portion 235 bending downward from a free end of the third intermediate portion 234 for electrically connecting with the PCB 200. The third intermediate portion 234 comprises a third lower horizontal section 2341 connecting with the third mating portion 233, a third upper horizontal section 2343 higher than and parallel to the third lower horizontal section 2341 and connecting with the third termination portion 235, and an inclined second connecting section 2242 connecting with the second lower horizontal section 2241 and the second upper horizontal section 2243. The second termination portion 225 is bifurcated to form four legs for being soldered with the PCB 200.

The third lower horizontal section 2341 is partially widened on both opposite lateral sides to form a flat third lower widened section 2344 for interferentially engaging with the third receiving passage 1331 defined in the third main section 133. The third upper horizontal section 2343 is partially widened on both lateral sides to form a flat third upper widened section 2345 for interferentially engaging with the third receiving channel 1332 in the third stretch section 1330. In the preferred embodiment of the present invention, the two opposite sides of the third lower widened section 2344 are formed with a plurality of barbs for retaining the third contact 23 in the insulative housing 1 more stably. The two opposite sides of the third upper widened section 2345 are flat for being assembled conveniently.

Each lower third contacts 232 has the substantially the same structure as that of the upper third contacts 230, except the curved directions of the third contacting ends 2330 are opposite to each other, and both toward the third receiving space 1310, and the lengths of the third connecting section 2342 and the third lower horizontal section 2341 of the lower third contact 232 is longer than that of the third connecting section 2342 and the third lower horizontal section 2341 of the upper third contact 230, while the length of the third upper horizontal section 2343 of the lower third contact 232 is shorter than that of the third upper horizontal section 2343 of the upper third contact 230. Thus, the shorter third termination portion 235 of the lower third contact 232 is located in front of the longer third termination portion 235 of the upper third contact 230. In summary, the pair of third mating portions 233 are arranged symmetrically and received in the pair of third receiving slots 1221 of the third mating port 122, while the other structure of the upper and lower second contacts 230, 232 are parallel to one another, with the lower third contact 232 beneath the upper third contact 220.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector, comprising:

an insulative housing comprising a main body and a first mating port extending from the main body, the first mating port defining a first receiving space therein, and the main body defining at least one front first receiving passage communicating with the first receiving space and at least one rear first receiving channel spaced from the front first receiving passage along a front-to-back direction and an up-to-down direction;

at least one first contact comprising a first mating portion partially exposed into the first receiving space of the first mating port, a first intermediate portion extending rearward from the first mating portion and received in the first receiving passage and the first receiving channel, and a first termination portion bending downward from the first intermediate portion and exposed beyond the insulative housing; and wherein the first intermediate portion comprises a first lower horizontal section received in the first receiving passage, a first upper horizontal section parallel to the first lower horizontal section and received in the first receiving channel, and a first connecting portion connecting the first lower horizontal section and the first upper horizontal section and extending between the first receiving passage and the first receiving channel, and wherein the first lower horizontal section is formed with a first lower widened section to interferentially engage with the first receiving passage, and the first upper horizontal section is formed with a first upper widened section to interferentially engage with the first receiving channel.

2. The electrical connector as claimed in claim 1, wherein there are two rows of first contacts arranged along an up-to-down direction to form a row of upper first contacts and a row of lower first contacts, and wherein the first mating port defines two rows of first receiving slots on opposite upper and lower walls and facing to the first receiving space to receive the first mating portions of the upper first contacts and lower first contacts with first contacting ends of the upper first contacts and the lower first contacts curved toward each other to be partially exposed into the first receiving space.

3. The electrical connector as claimed in claim 2, wherein the main body of the insulative housing defines two rows of first receiving passages corresponding to the first receiving slots arranged along the up-to-down direction and the first lower horizontal sections of the upper first contacts and the lower first contacts are respectively interferentially received in the first receiving passages, and the main body further forms a first stretch section extending rearward therefrom and defines two rows of first receiving channels along the up-to-down direction with the first upper horizontal sections of the upper first contacts and the lower first contacts respectively interferentially received in the first receiving channels.

4. The electrical connector as claimed in claim 3, wherein the main body forms a plurality of ribs protruding rearward from a rear surface thereof located between two pairs of adjacent first receiving passages for guiding the insertion of the first contacts.

5. The electrical connector as claimed in claim 1, wherein the main body forms a mounting surface for being assembled to a Printed Circuit Board (PCB), and wherein the mounting surface is higher than a bottom surface of the first mating port.

6. The electrical connector as claimed in claim 1, wherein opposite lateral sides of the first lower widened section and the first upper widened section are flat or in the form of a plurality of barbs.

7. The electrical connector as claimed in claim 2, further comprising a pair of second contacts, and wherein the first contacts are signal contacts, and the second contacts are power contacts with the second contact much wider than the first contact.

8. The electrical connector as claimed in claim 7, wherein the insulative housing further comprises a second mating port arranged side by side with the first mating port, and wherein the main body comprises a first main section corresponding to the first mating port, and a second main section arranged side by side with the first main section, and wherein the second contacts are arranged in two rows and accommodated in the second mating port and the second main section.

9. The electrical connector as claimed in claim 8, wherein the second mating port defines a second receiving space and a pair of second receiving slots in opposite upper and lower walls thereof facing to the second receiving space, and the second main section defines a pair of front second receiving passages communicating with the second receiving space and a pair of rear second receiving channels spaced from the front second receiving passages along a front-to-back direction and an up-to-down direction; wherein each of the second contacts comprises a second mating portion partially exposed into the second receiving space of the second mating port, a second intermediate portion extending rearward from the second mating portion and received in the second receiving passage and the second receiving channel of the second main section, and a second termination section bending from the second intermediate portion and extending beyond the insulative housing.

10. The electrical connector as claimed in claim 9, wherein the second intermediate portion comprises a second lower horizontal section received in the second receiving passage, a second upper horizontal section parallel to the second lower horizontal section and received in the second receiving channel, and a second connecting portion connecting the second lower horizontal section and the second upper horizontal section and extending between the second receiving passage and the second receiving channel.

11. The electrical connector as claimed in claim 10, wherein the second lower horizontal section is formed with a second lower widened section to interferentially engage with the second receiving passage, and the second upper horizontal section is formed with a second upper widened section to interferentially engage with the second receiving channel.

12. The electrical connector as claimed in claim 8, further comprising a pair of third contacts having the identical structures as that of the second contacts, a third mating port same as the second mating port, and a third main section same as the third main section.

* * * * *